United States Patent [19]

Pasersky

[11] 4,084,032

[45] Apr. 11, 1978

[54] PROCESS FOR MAKING HOT STAMPING FOIL FOR PRODUCING TEXTURED SURFACE EFFECTS

[75] Inventor: John D. Pasersky, Broomall, Pa.

[73] Assignee: Kurz-Hastings, Inc.

[21] Appl. No.: 662,919

[22] Filed: Mar. 1, 1976

Related U.S. Application Data

[63] Continuation-in-part of Ser. No. 539,168, Jan. 7, 1975, abandoned.

[51] Int. Cl.[2] ..... B44C 1/16; B41M 3/12

[52] U.S. Cl. ..... 428/172; 40/2.2; 40/616; 428/161; 428/200; 428/207; 428/335; 428/336; 428/349; 428/354; 428/913; 428/914; 427/148

[58] Field of Search ..... 428/156, 161, 200, 913, 428/914, 151, 200, 343, 349, 352, 353, 354, 332, 355, 172, 336, 207; 427/148, 256, 258, 267; 40/136, 2.2, 135, 267; 101/32; 156/230, 235, 219

[56] References Cited

U.S. PATENT DOCUMENTS

| | | | |
|---|---|---|---|
| 1,882,593 | 10/1932 | Hentschel | 428/200 |
| 2,089,949 | 8/1937 | Drewson | 427/278 |
| 3,359,127 | 12/1967 | Meyer | 428/200 |
| 3,770,479 | 11/1973 | Dunning | 428/200 |
| 3,953,635 | 4/1976 | Dunning | 428/914 |

FOREIGN PATENT DOCUMENTS

| | | | |
|---|---|---|---|
| 855,653 | 1970 | Canada | 427/148 |
| 1,218,058 | 1971 | United Kingdom | 427/148 |

*Primary Examiner*—George F. Lesmes
*Assistant Examiner*—Stanley S. Silverman
*Attorney, Agent, or Firm*—Paul & Paul

[57] ABSTRACT

A carrier sheet or material of indefinite length coated with heat transferable coatings usually referred to as hot stamp tape or foil is provided with a coat or coats of a material which provides the surface hot stamped with a textured surface, that is one that is truly three dimensional. Previous hot stamp tapes have provided a smooth surface or one that has a surface of varying specular gloss such as a ticked wood grain product.

1 Claim, 8 Drawing Figures

PROCESS FOR MAKING HOT STAMPING FOIL FOR PRODUCING TEXTURED SURFACE EFFECTS

CROSS-REFERENCE TO RELATED APPLICATION

This is a continuation-in-part of my pending application, Ser. No. 539,168, filed Jan. 7, 1975, now abandoned.

SUMMARY

It has for a long time been the desire of the hot stamping industry to produce a hot stamp tape that will not only decorate the surface that is hot stamped by changing its color or gloss but to also change the surface from one that is flat and smooth to one that is "textured" or to one that has the third dimension of depth. Previously this type of surface has been obtained by embossment of the surface before decorating and then forcing the coating down into the depressions.

More recently hot stamp tape carrier films have been provided with coatings or an etching that change the gloss of parts of the carrier web. These coatings do not transfer with the stamping but remain with the carrier web after transfer, and leave their mark on the surface of the stamping in the form of a different gloss. These effects have become commonly known as "ticks" and are usually in a wood grain design.

In accordance with the present invention, the hot stamping tape is provided with a coating or coatings in the form of a design but of such a magnitude (up to 1.5 mils) that one can actually feel the "bumps" when the hot stamping foil of this invention is transferred to the surface to be decorated. The bumps make the surface truly three dimensional, not only appearing to be so because of a gloss difference between the "hills" and "valleys". One can actually feel the textured surface as well as see it. This coating is applied in a novel way by the process of this invention. It makes use of a patterned negative embossing roller of the type that is used to emboss a film or any embossable surface. These rollers of course are currently well known and in use in engraving. The depressions therein are generally 4–5 mils deep. I have used this type roller in a different way, i.e., as a coating roller to apply a high solids solution or emulsion coating to the back side of a conventional hot stamping foil, thus rendering the foil three dimensional.

In carrying out the process of the present invention there is first provided a carrier sheet or web which may be any one of several types known to the art. For example, a polyester film such as "Mylar" (trademark of DuPont) or a sheet or web of cellulose acetate or cellophane. I have found that optimum results are achieved by use of polyester films such as "Mylar". The "Mylar" sheet or web is first coated with a transparent, colorless lacquer which has a relatively weak adhesion to the Mylar surface and is, therefore, self-releasing. A release coat may also be used before the lacquer if desired. An opaque color coat is then applied over the releasing lacquer coat consisting of color pigments and thermoplastic resins. Color prints may also be used between the lacquer and opaque color coat. The coatings are preferably applied by a gravure printing process but may be applied by roll coating or flow coating.

There is then applied to the opaque color coat an adhesive coat. Last of all a thermoplastic texture coat having ridges and depressions formed by the action of the embossing roller having a pattern formed therein and operating with the high solids ink. The embossing roller is conventional and well known in the art of embossing.

The completed hot stamping foil is applied to the object to be covered by placing the texture coat of the stamping foil against the surface to be covered and then applying heat and pressure to the Mylar side through the action of a heated rubber roll, after which the Mylar is stripped from the finished product which will now be characterized by a phsically textured surface resulting from the action of the hot silicone rubber reversing the coatings applied to the polyester film and transferring and adhering them to the substrate.

It is the object of the invention to provide a hot stamp tape that provides the decorated surface with a surface which is textured or three dimensional.

DETAILED DESCRIPTION

Figure 1:
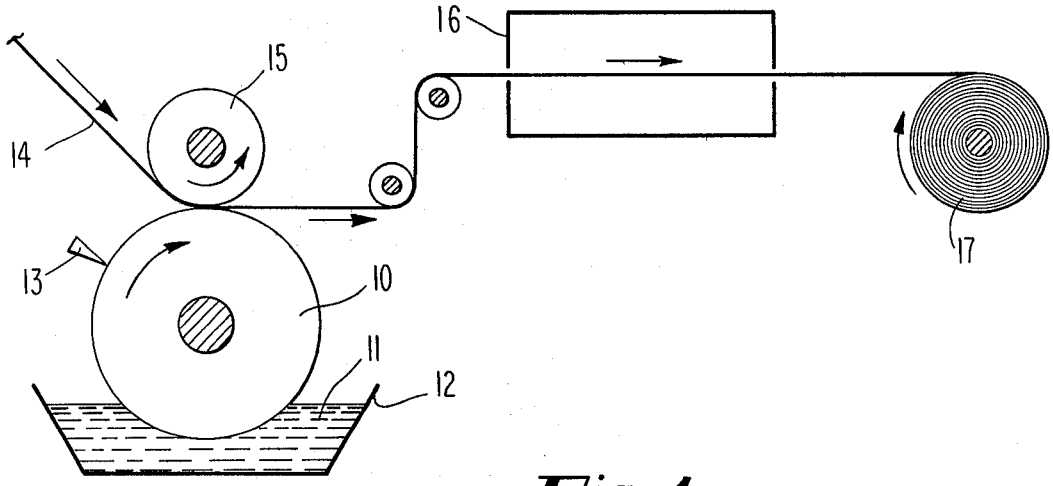
FIG. 1 is a flow sheet showing the process of producing the textured product of this invention.
Figure 2:
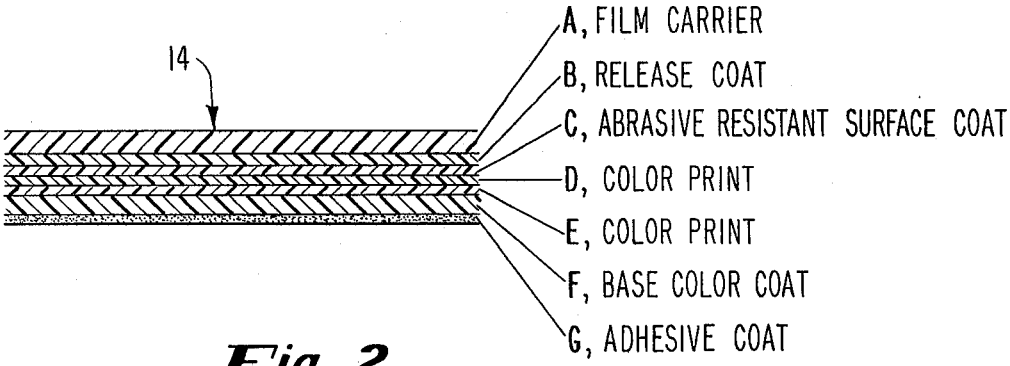
FIG. 2 is a sectional view of the material used to produce the textured product of this invention.

Referring to FIG. 1, a conventional engraving or negative embossing roll 10 is shown rotatably mounted such that its lower portion dips into coating material 11. This coating material 11 is contained by a conventional fountain 12. While the coating material 11 most preferred for use in accordance with the process of this invention is liquid, equivalently solid powdered coating material could be used in a magnetic or electrostatic application or comparable materials. Upon rotation of the roll 10 in the direction of the arrow shown thereon, the 4–5 mil depressions thereof are filled to overflowing with the coating material 11. Upon further rotation of roll 10, a doctor blade 13, suitably mounted as shown serves to remove excess coating material as in the engraving or gravure printing process. Above roll 10, a partially composed hot stamp foil 14 is led as a web between roll 10 and a rubber back-up roll 15. The sectional construction of the foil 14 before it passes between rolls 10 and 15 is shown in FIG. 2. The pressure of the thus constructed foil 14 passing through the nip of rolls 10 and 15 serves to draw out of the depressions of roll 10 discrete amounts of the coating material 11 up to about 1.5 mils thick. This material, specifically described hereinafter is provided with characteristics different from conventional rotogravure inks which are known to be extremely fluid. To the contrary, the coating material utilized in accordance with the process of this invention must have a body provided by a solids content that will leave the discrete amounts of coating material picked up or drawn from the roll 10 in place upon the back of the foil 14 in a manner that they will not substantially flow or slump out of their predetermined three dimensional shape. The resultant foil 14 having such applied coating material 11 thereon is shown in section in FIG. 3. In this form, foil 14 is then passed through a drying means 16 and then to wrap-up on a roll 17.

Figure 3:
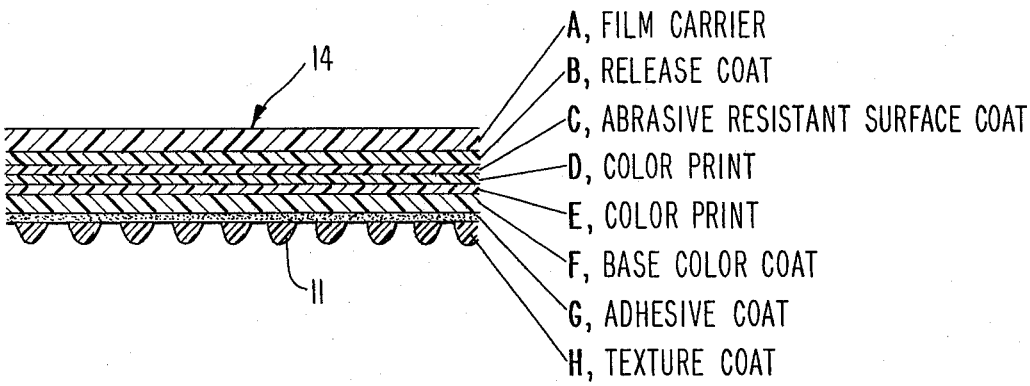
FIG. 3 is a sectional view of the product of the process shown in FIG. 1.
Figure 4:
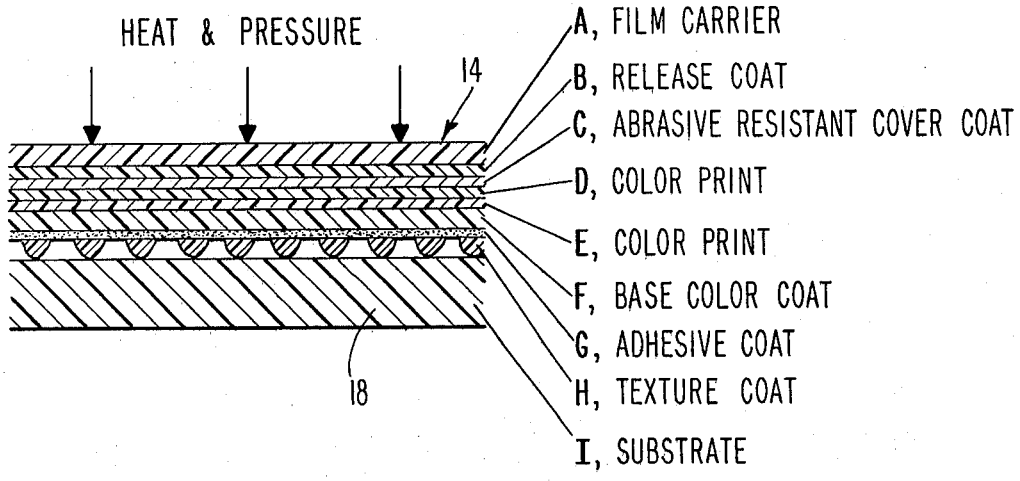
FIG. 4 is a sectional view showing the textured product of this invention being used in a process of hot stamping a substrate.
Figure 5:
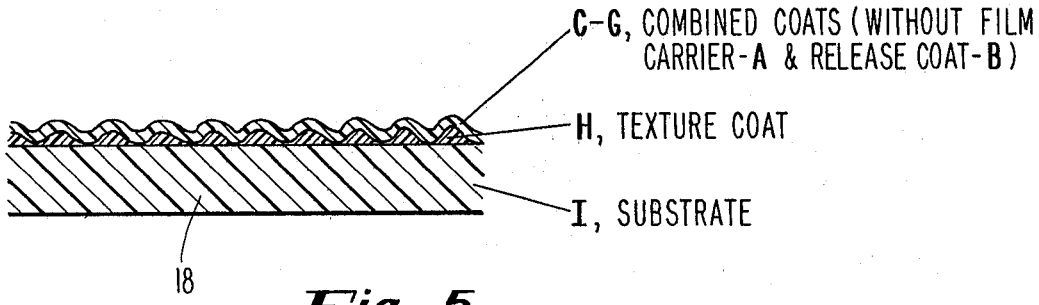
FIG. 5 is a sectional view showing the product of the hot stamping process shown in FIG. 4.

Referring to FIG. 4, a portion of foil 14 as constructed in FIG. 3 is positioned with respect to a substrate 18 as shown, whereupon heat and pressure from a resilient means (not shown) is applied thereto. The variable thickness texture coat in reaction with the resilient means causes the superposed foil layers to replicate obversely the surface of the texture coat, leaving a finished coated substrate with permanent truly threedimensional surface features as shown in FIG. 5.

The hot stamp tape or foil construction shown in FIG. 2 represents the most complex array of layers to be texture coated in accordance with the process of this invention. The manner of compiling these diverse layers is not part of this invention and is conventional, as shown for instance in U.S. Pat. No. 3,452,861, incorporated herein by reference. Of interest, however, is the relative thickness of each layer in FIG. 2 below the release coat B, as compared to the up to 1.5 mil thickness of portions of the texture coat H (FIG. 3). The abrasive resistant surface coat C has a thickness of from about 0.02–0.04 mil; the color print coats D, E are each from about 0.02–0.04 mil thick; the base color coat F is about 0.25 mil thick and the adhesive coat G is about 0.04 mils thick. The combined layers C-G therefore would have a thickness in the range of from about 0.35–0.41 mil, compared with the up to 1.5 mils thickness of the texture coat H. The relative thickness of the hills and valleys formed by the "bumps" in the textured coat H as shown in FIG. 5 would therefore be at least 4.5:1, an obviously three dimensional surface. Since the overlaying coats above the texture coat H in the embodiments of the product of this invention shown in FIGS. 6, 7 and 8 combine to form a laminate thinner than that overlaying the texture coat H in FIG. 5, it is obvious that these embodiments likewise create three dimensional surface effects.

The abrasion resistant surface coat may be composed of any coating system that provides a surface that resists wear. These are generally well known to the industry. A typical example is a lacquer composed of methyl methacrylate resins and micronized polyethylene.

The color print coats are conventional inks common to the gravure printing industry. These inks may be composed of polyvinyl chloride or polyvinyl acetate copolymer resins, and plasticizers such as dioctyl phthalate and iron oxide pigments. These are usually printed using the gravure printing technique but also may be applied by silk screening, letter press printing or the like. Any number of printed designs may be used to obtain various printed effects, such as woodgrain designs, leather designs, marble designs, cloth designs, and the like.

The base color coat is the coating that provides the hot stamping foil or sheet with its ability to "hide" the substrate. It also provides another color dimension as well as the property of coverage. It may be composed of methyl methacrylate resins, plasticizers, together with iron oxide pigments, titanium dioxide pigments, or any suitable colored pigments or combination thereof.

The adhesive coat is the coating that may be used to bond all of the coatings applied before it, to the surface to be decrated and to the texture coat. It is composed of a resin system that softens at a desired temperature and has the property of adhesion to the surface to be decorated. It may be composed of a methylmethacrylate copolymer resin solution, or a polystyrene resin solution or any suitable resinous adhesive.

The texture coat is essential to the stamping foil of the invention. It is composed of low viscosity thermoplastic resins, and plasticizers along with calcium carbonate pigment or colored pigments if desired. Its solids content must be high. It may be composed of a methyl methacrylate copolymer resin, a limed polymerized rosin, plasticizer, calcium carbonate and black iron oxide or other desired pigments. It is formulated to a viscosity of about 7–10 thousand cps. It is applied to the adhesive coat, by the action of the negative embossing roller, used as a gravure or intaglio printing roller. This deposits the texture coat in the shape of the embossing roller surface. Therefore, when the hot stamping is completed and the coatings are reversed the resulting surface of the decorated part is essentially similar to one that would result if the roller had been used to emboss the surface of the decorated part before hot stamping.

Figure 6:
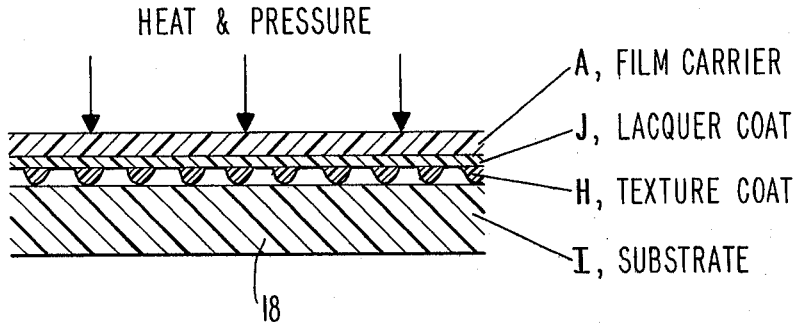
FIG. 6 is a sectional view showing the use of another embodiment of the product of this invention.

FIG. 6 describes the simplest of the variations. It is composed of the film carrier A and a single coat of a pigmented thermoplastic lacquer J, similar to the color coat of FIG. 2. To this is applied the texture coat. When hot stamped, it decorates the surface stamped in one color and provides the textured surface. Usually physical properties of this type are low.

Figure 7:
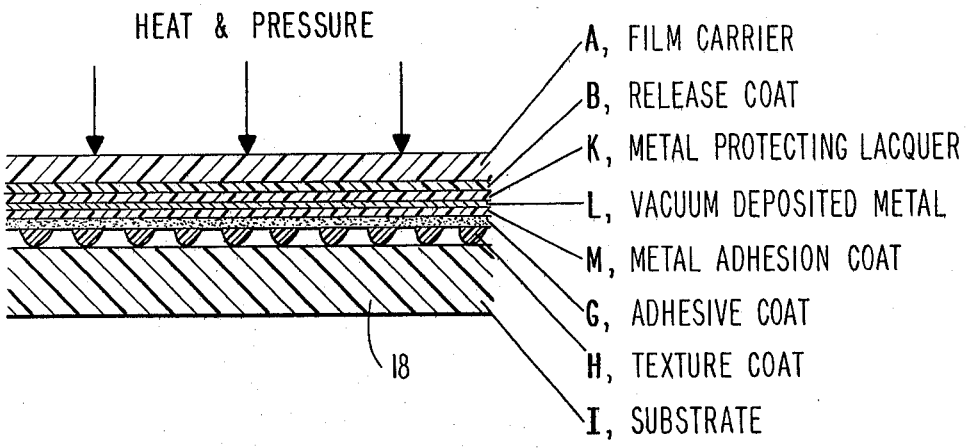
FIG. 7 is a sectional view showing the use of another embodiment of the product of this invention.

FIG. 7 describes a vacuum metalized hot stamping foil, which is well known, provided with the texture coat. Its composition is similar to those in FIG. 2 except for the need of the thin layer of vacuum applied aluminum metal L. It may be possible to use other metals such as chromium, copper, gold, or any other metal that may be vacuum deposited.

Figure 8:
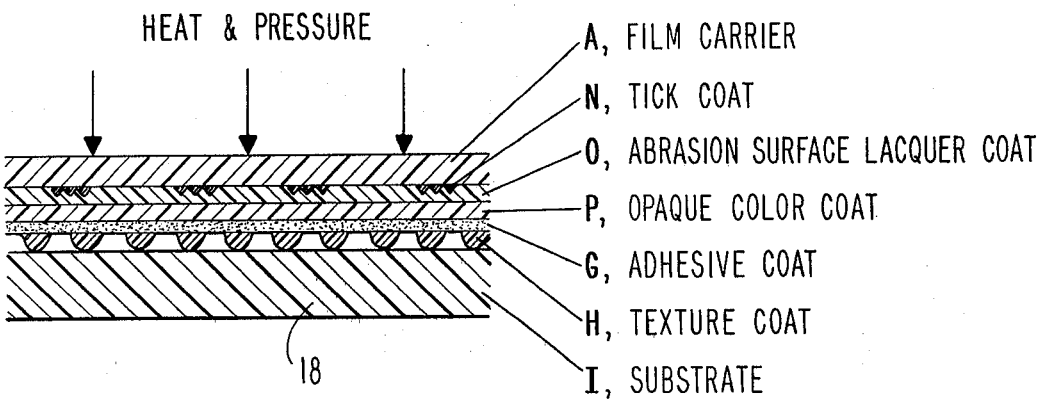
FIG. 8 is a sectional view showing the use of another embodiment of the product of this invention.

FIG. 8 describes a hot stamping foil that is provided with a surface that is "ticked". This, of course, is a process that has recently become known to the stamping foil industry. It is usually used to provide a wood grain stamping foil with the appearance of having natural wood "ticks" in the surface. "Ticking" is done by applying a printed coat to the film carrier which changes the specular reflectivity of the carrier in the printed area. This gloss difference is transferred to the wood grain surface after hot stamping.

The texture coat may be applied to this type of stamping foil, as shown, thus providing it with a three dimensional surface in addition to a ticked surface.

In some cases, the textured effect of the process of this invention may be enhanced by applying two successive texture coats, each of which is produced by a patterned embossing roller with the respective textures being in register or not in register.

The following are typical formulas for the coatings shown in the drawings:

| | |
|---|---|
| Release Coat | |
| Ester Wax | 1.5% |
| 1,1,1 Trichlorethylene | 77.9% |
| Trichlorethylene | 20.6% |
| Abrasion Resistant Surface Coat | |
| Methylmethacrylate Resin | 12.7% |
| Polyethylene Resin | 1.2% |
| Toluene | 22.4% |
| Methyl Isobutyl Ketone | 31.8% |
| Methyl Ethyl Ketone | 19.1% |
| Butyl Alcohol | 12.8% |
| Color Print | |

-continued

| | |
|---|---|
| Iron Oxide Pigments | 11.4% |
| Aluminum Silicate | 3.6% |
| Methylmethacrylate Resin | 6.4% |
| Plasticizer DOP | 1.6% |
| Copolymer Acrylic Resin | 1.6% |
| Methyl Isobutyl Ketone | 54.2% |
| NUOSPHERSE 657 (Tenneco Chem.) | 0.4% |
| Toluol | 20.4% |
| Tetrahydrofuran | 0.4% |
| Base Color Coat | |
| Methylmethacrylate Resin | 7.5% |
| Plasticizer DOP | 5.4% |
| NUOSPERSE 657 (Tenneco Chem.) | 0.4% |
| Ethyl Alcohol | 0.4% |
| Aluminum Silicate | 3.2% |
| Iron Oxides | 19.4% |
| Titanium Dioxide | 12.1% |
| Ethylene Glycol Mono Ethyl-Ether Acetate | 3.7% |
| Copolymer Acrylic Resin | 1.1% |
| Butanol | 1.6% |
| Toluol | 45.2% |
| Adhesive Coat | |
| Methyl/N Butyl Methacrylate Copolymer | 23.1% |
| Toluol | 42.7% |
| Ethyl Alcohol | 9.2% |
| Aliphatic Hydrocarbon Solvent | 25.0% |
| Texture Coats | |
| Black | |
| Toluene | 34.0% |
| Methyl Methacrylate Copolymer Resin | 11.7% |
| Limed Polymerized Rosin | 7.1% |
| Plasticizer DOP | 1.1% |
| Ethylene Vinyl Acetate Copolymer | 4.4% |
| Black Iron Oxide | 7.5% |
| Calcium Carbonate | 34.2% |
| Black | |
| toluene | 40.2 |
| Methylmethacrylate Copolymer Resin | 10.4% |
| Limed Polymerized Rosin | 6.2% |
| Plasticizer DOP | 1.0% |
| Ethylene Vinyl Acetate Copolymer | 3.9% |
| Black Iron Oxide | 7.9% |
| Calcium Carbonate | 30.4% |
| Black | |
| Toluene | 25.1% |
| Methylmethacrylate Copolymer Resin | 13.0% |
| Limed Polymerized Rosin | 6.2% |
| Plasticizer DOP | 1.3% |
| Ethylene Vinyl Acetate Copolymer | 4.9% |
| Black Iron Oxide | 7.9% |
| Calcium Carbonate | 38.0% |
| White | |
| Toluene | 39.8% |
| Methylmethacrylate Copolymer Resin | 10.6% |
| Limed Polymerized Rosin | 6.4% |
| Plasticizer DOP | 1.1% |
| Ethylene Vinyl Acetate Copolymer | 4.1% |
| Titanium Dioxide | 6.8% |
| Calcium Carbonate | 31.2% |
| White | |
| Toluene | 24.8% |
| Methylmethacrylate Copolymer Resin | 13.3% |

-continued

| | |
|---|---|
| Limed Polymerized Rosin | 8.0% |
| Plasticizer DOP | 1.3% |
| Ethylene Vinyl Acetate Copolymer | 5.1% |
| Titanium Dioxide | 8.5% |
| Calcium Carbonate | 39.0% |
| Orange | |
| Toluene | 40.0% |
| Methylmethacrylate Copolymer Resin | 10.5% |
| Limed Polymerized Rosin | 6.3% |
| Plasticizer DOP | 1.1% |
| Ethylene Vinyl Acetate Copolymer | 4.0% |
| Cadmium Lithopone | 7.4% |
| Calcium Carbonate | 30.7% |
| Orange | |
| Toluene | 24.8% |
| Methylmethacrylate Copolymer Resin | 13.2% |
| Limed Polymerized Rosin | 7.9% |
| Plasticizer DOP | 1.3% |
| Ethylene Vinyl Acetate Copolymer | 5.0% |
| Cadmium Lithopone | 9.3% |
| Calcium Carbonate | 38.5% |
| Metal Protecting Lacquer | |
| Nitrocellulose 18-25 cps RS | 8.5% |
| Methyl Methylmethacrylate Resin | 8.5% |
| Methyl Ethyl Ketoxe | 73.0% |
| Ethylene Glycol Mono Ethyl Ether | 10.0% |
| Metal Adhesion Coat | |
| Maleic Acid Modified Vinyl Chloride-Vinyl Acetate Copolymer Resin | 1.8% |
| Isopropyl Acetate | 98.2% |
| Tick Coat | |
| Melamine Resin | 14.8% |
| Davidson Chemical Syloid 244 | 7.8% |
| Lampblack | 0.6% |
| Short Oil Alkyd Resin | 23.3% |
| Paratoluene Sulfonic Acid | 3.7% |
| Ethyl Alcohol | 24.3% |
| Xylene | 18.1% |
| Butyl Alcohol | 7.4% |

It will be seen from the above formulations that the novel texture coatings of this invention may be formed from ink compositions having from about 60% to about 75% solids.

Having thus described my invention, I claim:

1. A hot stamping foil for producing textured surface effects consisting essentially of (1) a carrier sheet, (2) a releasing lacquer coat, applied to said carrier sheet, (3)an opaque color coat applied to said releasing lacquer coat, (4) a heat and pressure activatable resinous adhesive coat applied to said opaque color coat, wherein the combined thickness of (3) and (4) is about 0.35 to 0.41 mil and (5) a textured coat of up to about 1.5 mils thick applied to said adhesive coat and consisting essentially of a threedimensional pattern ridges and depressions formed from a low viscosity thermoplastic composition high solids ink.

* * * * *